US005669188A

United States Patent [19]

Jaruzel

[11] Patent Number: 5,669,188

[45] Date of Patent: Sep. 23, 1997

[54] LINING BOARD WITH A SUPPORT WITH AN APPROXIMATELY U-SHAPED CROSS SECTION

[75] Inventor: Kurt Jaruzel, Haslach, Germany

[73] Assignee: Paschal-Werk G. Maier GmbH, Steinach, Germany

[21] Appl. No.: 578,530

[22] PCT Filed: Jun. 29, 1994

[86] PCT No.: PCT/EP94/02115

§ 371 Date: Jan. 5, 1996

§ 102(e) Date: Jan. 5, 1996

[87] PCT Pub. No.: WO95/02101

PCT Pub. Date: Jan. 19, 1995

[30] Foreign Application Priority Data

Jul. 5, 1993 [DE] Germany ..... 43 22 271.4

[51] Int. Cl.[6] ..... E04G 9/08; E04G 9/02; E04G 11/06; E04G 17/14

[52] U.S. Cl. ..... 52/127.3; 52/632; 52/801.11; 249/24; 249/210; 249/219.1

[58] Field of Search ..... 52/800.1, 801.1, 52/801.11, 127.3, 632; 249/24, 210, 219.1

[56] References Cited

U.S. PATENT DOCUMENTS

| | | | |
|---|---|---|---|
| 14,807 | 2/1856 | McKay | 249/24 X |
| 1,287,573 | 12/1918 | Davidson | 249/193 X |
| 1,292,986 | 2/1919 | Ambursen | 249/44 X |
| 3,854,693 | 12/1974 | Kistler | 249/210 |
| 5,492,303 | 2/1996 | Jarunzel | 249/210 X |
| 5,509,635 | 4/1996 | Jarunzel | 249/47 |

FOREIGN PATENT DOCUMENTS

| | | | |
|---|---|---|---|
| 2 609 488 | 7/1988 | France . | |
| 1 235 559 | 3/1967 | Germany . | |
| 1 284 608 | 12/1968 | Germany . | |
| 2 140 137 | 2/1972 | Germany . | |
| 24 26 708 | 6/1978 | Germany . | |
| 1224021 | 9/1996 | Germany | 249/24 |
| 2133826 | 8/1984 | United Kingdom | 249/47 |
| WO92/20887 | 11/1992 | WIPO . | |

*Primary Examiner*—Wynn E. Wood
*Assistant Examiner*—Laura A. Saladino
*Attorney, Agent, or Firm*—Panitch Schwarze Jacobs & Nadel, P.C.

[57] ABSTRACT

The form panel (1) has a lining skin (2) and girders (4) supporting the lining skin (2) on the side averted from the concrete, as well as possibly marginal webs (3) which run approximately parallel to the girders (4) and enable adjacent form panels (1) to be coupled and connected to one another. The girders (4) have an approximately U-shaped cross section, the U-limbs (5) departing from a U-crosspiece (6) to diverge slantwise and having at their free ends, where they are furthest apart from each other, oppositely directly fastening flanges (7) for joining to the lining skin (2). For the form panel to be extended on at least one side in continuation of the longitudinal direction of the girders (4), the girder (4) in question consists of at least two girder parts or portions (4*a*) and (4*b*) which are adjustable relative to each other in the longitudinal direction and embrace each other at least in an overlapping zone, whereby inside the cross section of the internal girder portion (4*b*) the U-limbs thereof form together with the lining skin (2) an angle of inclination which is more obtuse or larger than the corresponding angle of the girder portion (4*a*) embracing the girder portion (4*b*), or the angle between the two U-limbs of the internal girder portion (4*b*) is more acute than the corresponding angle between the U-limbs (5) of the external girder portion (4*a*).

11 Claims, 5 Drawing Sheets

Fig. 2
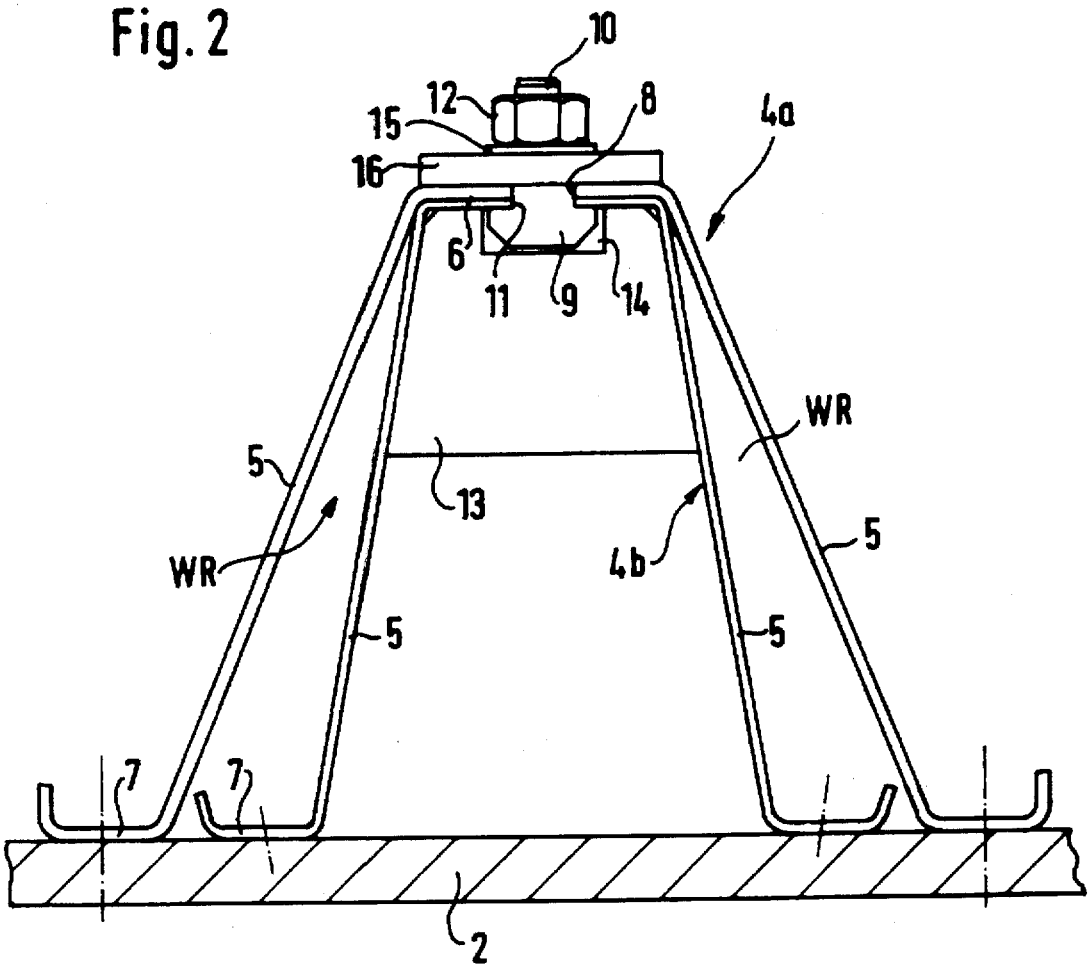
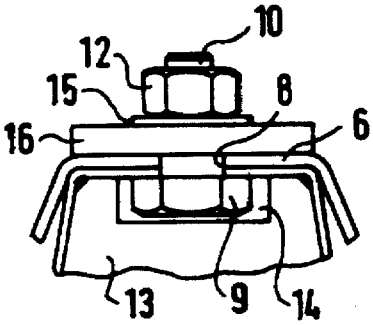
Fig. 3
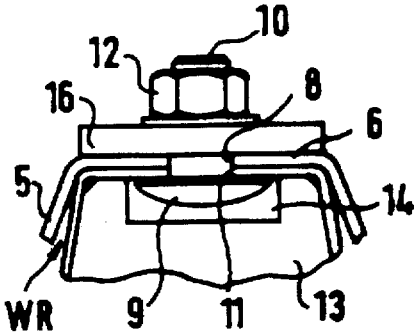
Fig. 4

Fig. 5
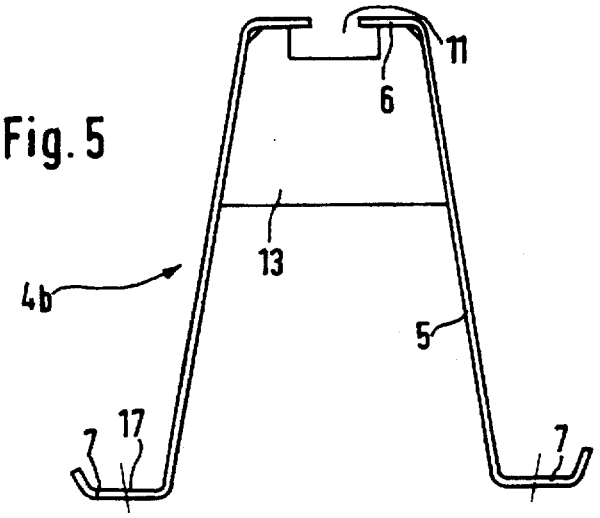
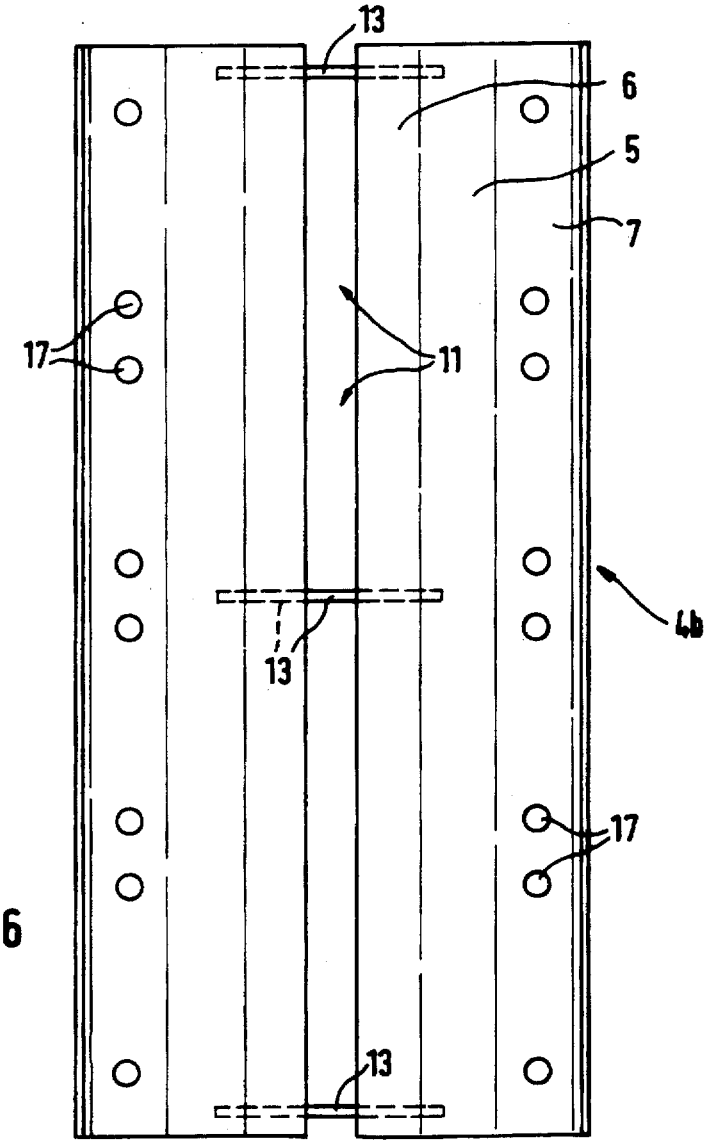
Fig. 6

LINING BOARD WITH A SUPPORT WITH AN APPROXIMATELY U-SHAPED CROSS SECTION

FIELD OF THE INVENTION

The invention relates to a form panel with at least one girder which supports the lining skin on the side averted from the concrete and has an approximately U-shaped cross section, the U-limbs of the girder being connected by a U-crosspiece situated on the side averted from the lining skin, and the U-limbs—viewed in cross section—diverging slantwise from the U-crosspiece and in each case having at their free ends—viewed in cross section—oppositely directed fastening flanges which project outwardly from the U-limbs and serve for being applied to the lining skin.

BACKGROUND OF THE INVENTION

Such a form panel is known for instance from German Patent Specification No. 24 26 708. The form panels described therein are parts of large-size formwork for surfaces of varying curvature, having a lining skin adjustable with respect to their curvature. Features serving this purpose are that as the curvature is changed the U-limbs are laterally movable without permanent deformation and boom sections of variable length are applied to the U-crosspieces. This formwork has proved successful.

If it is necessary, however, that formwork work exceeding the height of such a form panel be carried out above or beneath it, it has hitherto been difficult to extend the form panel in an upward or downward direction. This applies particularly when, for instance, shuttering the side wall of a ramp or inclined approach which may run straight ahead or at the same time in a curve.

SUMMARY OF THE INVENTION

The object underlying the invention is therefore to provide a form panel of the kind mentioned at the outset, enabling the girders having an approximately trapezoidal cross section to be extended very simply in spite of the projecting fastening flanges on them.

This object is accomplished in that the girder consists of two U-shaped girder parts or portions which are adjustable relative to each other in the longitudinal direction and embrace each other at least in an overlapping zone, whereby inside the cross section of the at least partially internal girder portion the U-limbs thereof form together with the lining skin an angle of inclination which is more obtuse or larger than that of the external girder portion embracing the internal girder portion, and that at the lining skin the clear width between the U-limbs of the internal girder portion is at least the total width of the oppositely directed fastening flanges smaller than that between the U-limbs of the external girder portion, and that the fastening flanges of both girder portions lie side by side in the same plane.

Despite the requirement of providing the U-limbs with outwardly projecting fastening flanges for joining to the lining skin, so as to be able to fasten the girder parts or portions to the lining skin and if necessary to allow some deformation for adaptation of the curvature, it is hence achieved that the girders can be extended in their longitudinal direction in a simple way. It is true that there have already been telescopically extensible girder parts in formwork construction, however the inside cross sections of their external portions correspond to the outside cross sections of their internal portions. To allow for the fastening flanges, the cross sections of the two girder portions of the form panel according to the invention differ considerably from each other in that the angle included by the U-limbs is more acute in the case of the internal girder portion than in the case of the girder portion embracing the latter. The fastening flanges of the two girder portions are therefore in each case at different distances from each other and the internal girder portion together with its projecting flanges can be accommodated within the external girder portion. It is nevertheless ensured that the internal girder portion also has—viewed in cross section—limbs diverging slantwise which are movable with their fastening flanges without permanent deformation when the curvature of the form panel is changed. At the same time correspondingly good stiffness is produced, also in the extension zone. In the case of a vertically arranged girder, such an extension can be effected in both a downward and an upward direction.

The U-crosspieces of the two partly interlocking girder portions may be contiguous in the position of use and may be adapted to be detachably connected to each other. The two girder portions, the U-limbs of which diverge due to their differing angularity, can be coupled or connected simply at the U-crosspieces. The fastening of the fastening flanges to the lining skin naturally also additionally produces a stiffening.

Extension of nesting girder portions can be achieved by initially detaching them and then re-fastening them in a different relative position to each other. However it is faster and simpler if the girder portions are slidable relative to each other in the longitudinal direction of the girder and a slideway or longitudinal guideway, particularly at least an elongated slot, is provided at the U-crosspieces of at least one girder portion. This not only permits the total length of the girder to be altered quickly by sliding its girder portions relative to each other, but also enables progressive adjustment to different lengths.

A suitable arrangement particularly with respect to guiding the girder portions for sliding movement relative to each other may consist in that fasteners having a radially protruding projection or head engage with perforations of the girder portion situated externally in the position of use, the projection or head being located inside the girder portion and engaging under companion guiding means in the form of the edges of an elongated slot or similar guide of the internal girder portion, and that the fastener is adapted to be braced or tightened relative to the internal girder portion. Such fasteners may hence traverse both girder portions in their overlapping zone and be applied with a projection or head to the internal girder portion. The latter is slidable relative to this head by means of an elongated slot, but can also be fixed and clamped in the respective, set position by bracing the fastener.

It is particularly advantageous if the fastener has at the outside of the girders a thread and a nut that can be tightened on it. In practice therefore a bolt with almost any head can serve as the fastener. In the interior the head of the bolt engages under companion guiding means in the form of the edges of the longitudinal slot of the internal girder portion, while at the outside a standard threaded nut in the loose condition permits the girder portions to slide relative to each other during the length adjustment and in the tightened condition fixes them relative to each other.

Appropriate measures may be taken to ensure that the projection or head of the fastener is not entrained as the nut is tightened. By way of example, this head may have appropriate plane surfaces and be located in a recess in such a way as to prevent it from twisting.

The internal girder portion may be composed of two approximately z-shaped girder sections which are spaced from each other in the region of the U-crosspiece by a slot and are held together by cross connectors or cross plates situated in the interior of the U-cross section. In this manner a continuous guide slot throughout the length of the internal girder portion is produced. In addition, after having been joined together by cross plates, the z-shaped girder sections may as a whole have a stiffness so great that the forces arising in the extension zone of such form panels can be dependably sustained. Any subsequent milling out of a Guide slot can be avoided.

The cross connectors or cross plates of the internal girder portion may have situated in the region of the guide slot of the girder portions a recess, the inner width of which is larger than that of the companion guiding means or larger than that of the head of the fastener. Therefore these cross plates do not represent any obstacle when the total length of the girder is changed. The fastening element may be a hammer-head bolt rendering it unnecessary for the head to be counter-held during fastening, because due to the shape of the head it can rest against the inside in such a way as not to be entrained.

The cross connectors or cross plates of the internal girder portion may also contact the U-crosspiece from the inside and from there be applied to only part of the cross-sectional length of the U-limbs of this girder portion. By this means on the one hand a sufficiently firm connection of the z-shaped girder sections is achieved, but on the other hand the elastic ductility of the U-limbs is maintained. The U-limbs of the girder portions are hence laterally movable without permanent deformation and the form panel is adapted to be curved and varied in its curvature about one or a plurality of axes running parallel to the girder(s). Therefore in a multi-storey car park, for instance, with a track running uphill at a slant and at the same time forming a curve, it involves no difficulty to shutter the side wall with the requisite curvatures equivalent to the sweep of the curve. At the same time the gradient of the track can be allowed for by equivalent, varying extensions of the girders of the form panels.

In order that a minimum number of cross connectors or cross plates at the internal girder portion suffices, the cross connectors or cross plates may be at a spacing which amounts to at least almost the length of the girder portion or preferably somewhat less than half that length. Two or three cross connectors or cross plates may be distributed over the length of the girder portion in such a way that one such cross connector or cross plate is provided near each front end and particularly midway of the girder portion. Depending on the length of this girder portion situated partly internally in the position of use, such cross connectors can hence be provided either at its ends or a cross connector may additionally be arranged midway to improve the mutual stiffening of the z-shaped girder sections. This girder portion serving for extension is therefore correspondingly simple to produce.

Altogether a form panel ensues which can used to advantage particularly in curvatures and enables upward and/or downward extension in the direction of the stiffening girders. In an advantageous way the extension parts have a likewise trapezoidal shape, hence in this respect the same geometrical shape as the girder portions or trapezoidal girders on the form panel. However, the dimensions in the cross section of the extension parts are modified in such a way that the extension parts are progressively slidable relative to those girder portions, although the U-limbs of the extension parts are each provided with an outwardly projecting flange for connection to the lining skin. Since the guide slots are provided on the slidable girder portions, it is possible to retrofit them to existing form panels having stiffening girders of approximately trapezoidal cross section.

BRIEF DESCRIPTION OF THE DRAWINGS

Exemplified embodiments of the invention will be described in further detail below with reference to the drawings in which, partly in schematized form, FIG. 2 is a front view of a girder according to the invention, consisting of two girder portions which are adjustable relative to each other in the longitudinal direction and embrace each other in an overlapping zone, FIG. 3 is a partial view according to FIG. 2 with a modified fastener for connecting the two girder portions in their overlapping zone, FIG. 4 is a view corresponding to FIG. 3 with an again modified fastener, FIG. 5 is a front view of a girder portion fitting inside the other girder portion, FIG. 6 is the girder portion of FIG. 5 before being fitted in the further girder portion, in a view taken from the rear averted from the concrete in the position of use.

DETAILED DESCRIPTION OF PREFERRED EMBODIMENTS

Figure 1:
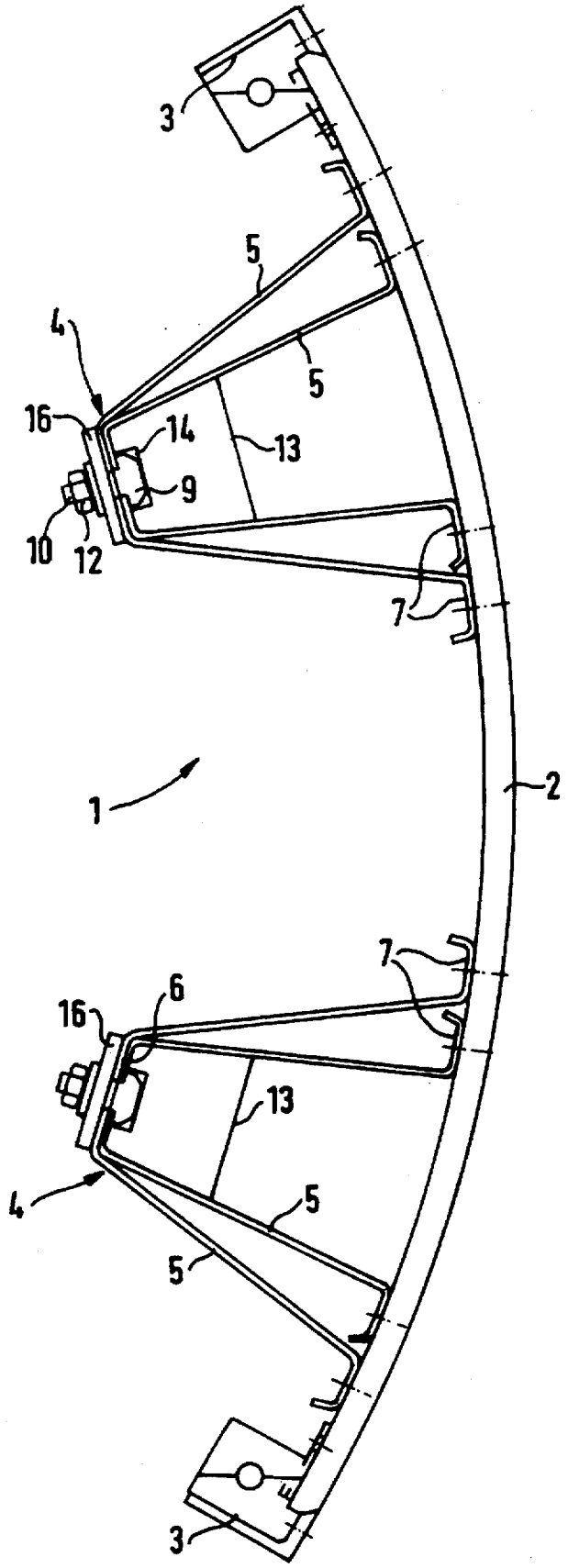
FIG. 1 is a plan view of a curvilinear form panel with a marginal section and two parallel girders on the side averted from the concrete, not showing means possibly provided for fixing and perhaps adjusting the curvature.

In the exemplified embodiment according to FIG. 1, a form panel generally designated 1 has, located on that side of the lining skin 2 which is averted from the concrete and beside two marginal webs 3 for coupling to neighbouring form panels, supporting girders each having an approximately U-shaped cross section and generally designated 4. FIG. 2 also shows that this girder 4, which supports the lining skin 2 on the side averted from the concrete, has its U-limbs 5 indirectly or directly connected by a U-crosspiece 6 situated on the side averted from the lining skin 2. Viewed in cross section, the U-limbs 5 diverge slantwise from the U-crosspiece 6, symmetrically to a longitudinal median plane perpendicular to the lining skin 2. The U-limbs 5 hence in each case have the same angle of inclination relative to the lining skin and this longitudinal median plane.

The U-limbs 5 each have at their free ends or edges—again viewed in cross section—oppositely directed fastening flanges 7 which project outwardly from the U-limbs 5 and serve for being applied to the lining skin 2, hence for fastening e.g. by means of screws.

It is apparent particularly in the light of FIG. 2 in conjunction with FIGS. 7 to 10 that the respective girder 4 consists of two girder parts or portions **4*a* and 4*b* which are adjustable relative to each other in the longitudinal direction and embrace each other at least in an—analogously adjustable—overlapping zone, whereby inside the cross section of the at least partially internal girder portion 4b the U-limbs 5 thereof form together with the lining skin 2 an angle of inclination which is more obtuse or larger than that of the external girder portion 4a embracing the internal girder portion 4b. In other words, the angle between the limbs 4b is smaller or more acute than that between the U-limbs 4a. Hence follows an acute-angled space WR between the limbs 5 of girder portion 4a and those of girder portion 4b, as is clearly to be seen in FIG. 2**.

At the location at which the U-limbs 5 are or become connected to the lining skin 2, the clear width between the U-limbs 5 of the internal girder portion 4b is at least the total width of the oppositely directed fastening flanges 7 smaller than that between the U-limbs 5 of the external girder portion 4a. For, in the position of use, the fastening flanges 7 of both girder portions 4a and 4b lie side by side in the same plane, as long as the lining skin 2 is not curved but is level in accordance with FIG. 2. However, even when the lining skin 2 is curved, the fastening flanges 7 directly adjacent to one other of girder portions 4a and 4b lie approximately in a coincident tangential plane.

It is important that by means of different angles of inclination of the U-limbs 5, the two girder portions 4a and 4b nest in spite of the oppositely directed fastening flanges 7, but have a lateral movability without permanent deformation if the form panel 1 is to be curved or changed in its curvature. The form panel illustrated in FIG. 1 has on the lining skin 2 two girders 4 consisting in each case of girder portions 4a and 4b, whereby the U-limbs of the girder portions 4a and 4b are laterally movable—as mentioned—without permanent deformation and the form panel 1 is adapted to be curved and changed in its curvature about one or a plurality of axes running parallel to the girder(s) 4. The means, e.g. turnbuckles, which are applied to the girder 4 zones remote from the lining skin 2 in order to change and fix the respective curvature of the lining skin 2, are not entered in the drawings because their design is not at issue.

According to FIG. 2, the U-crosspieces 6 of the two partially interlocking girder portions 4a and 4b are contiguous in the position of use, as far as the girder portions 4a and 4b overlap, and are detachably connected to each other in this zone. An extension once set by sliding the two girder portions 4a and 4b relative to each other in their longitudinal direction can hence be fixed accordingly.

The girder portions might also be joined in different positions relative to each other, however in the exemplified embodiments it is contemplated in a manner suitable for simple handling that the girder portions 4a and 4b are slidable relative to each other in the longitudinal direction of the girder 4 and a slideway or longitudinal guideway, particularly at least an elongated slot, is provided on the U-crosspieces 6 of a girder portion.

Figure 7:
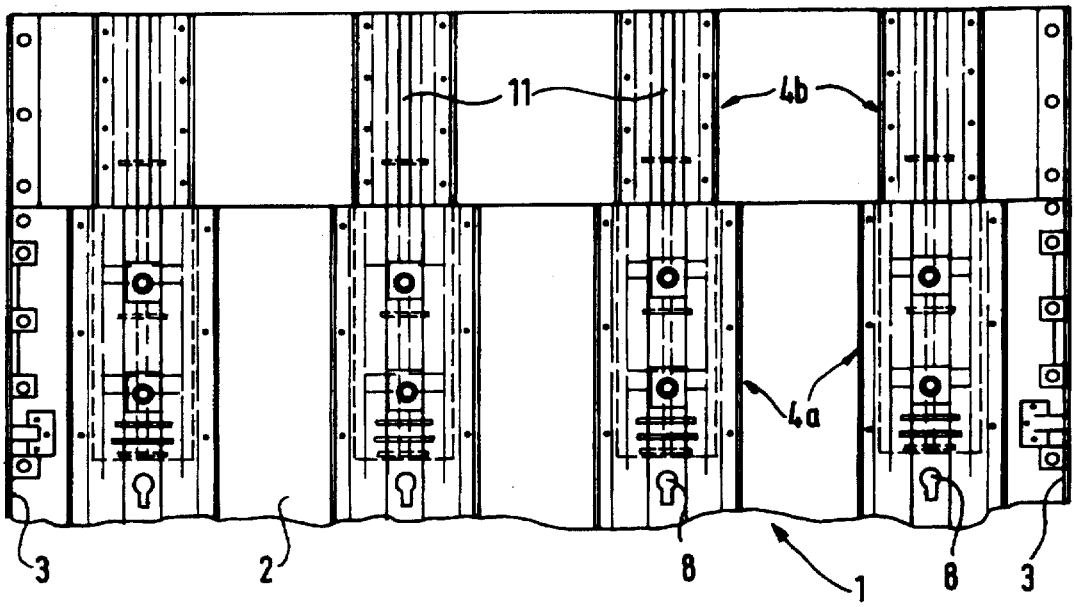
FIG. 7 is a rear view of a form panel with four girders each extended the same length in an upward direction.
Figure 8:
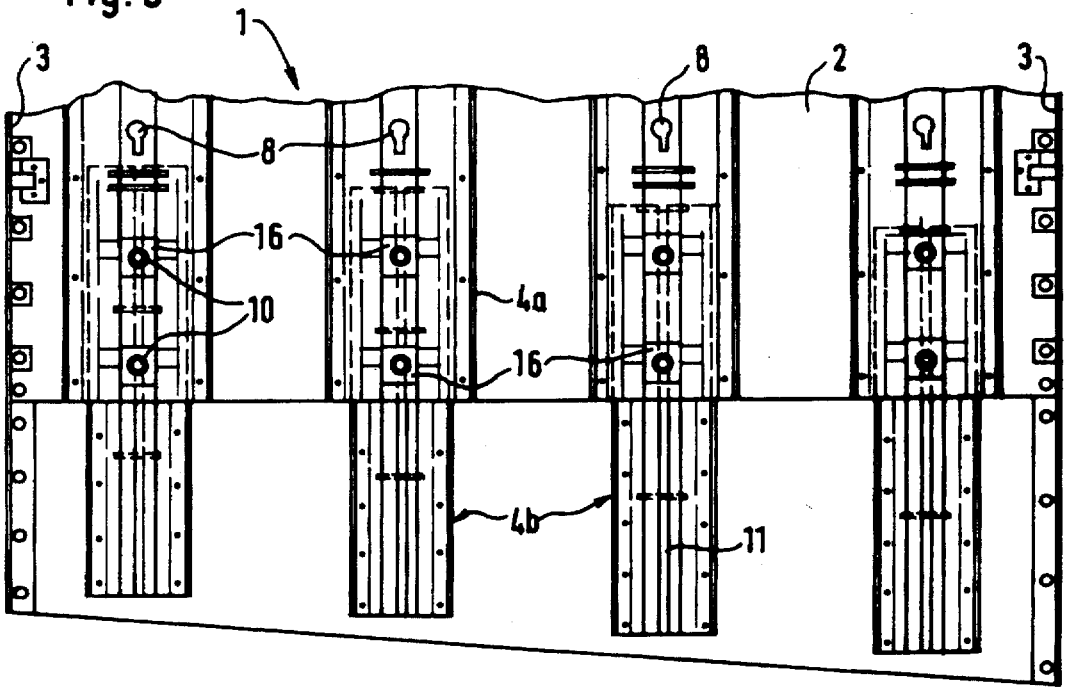
FIG. 8 is a view of a form panel with girders extended increasing lengths at its underside in order to form a lower, slanting edge.
Figure 9:
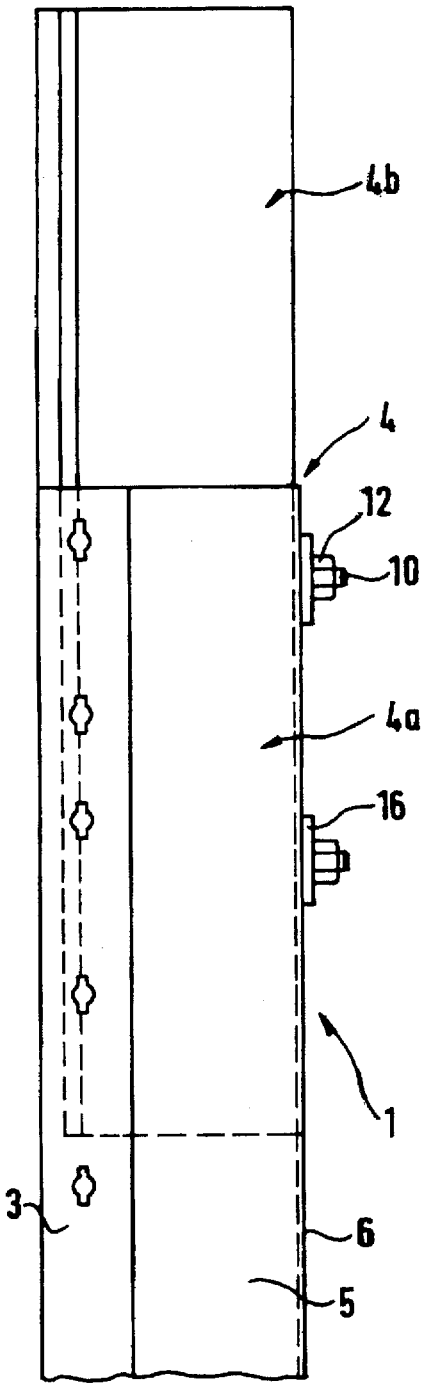
FIG. 9 is a side view of a form panel with an upward extension and FIG. 10 is a side view of a form panel with a downward extension.
Figure 10:
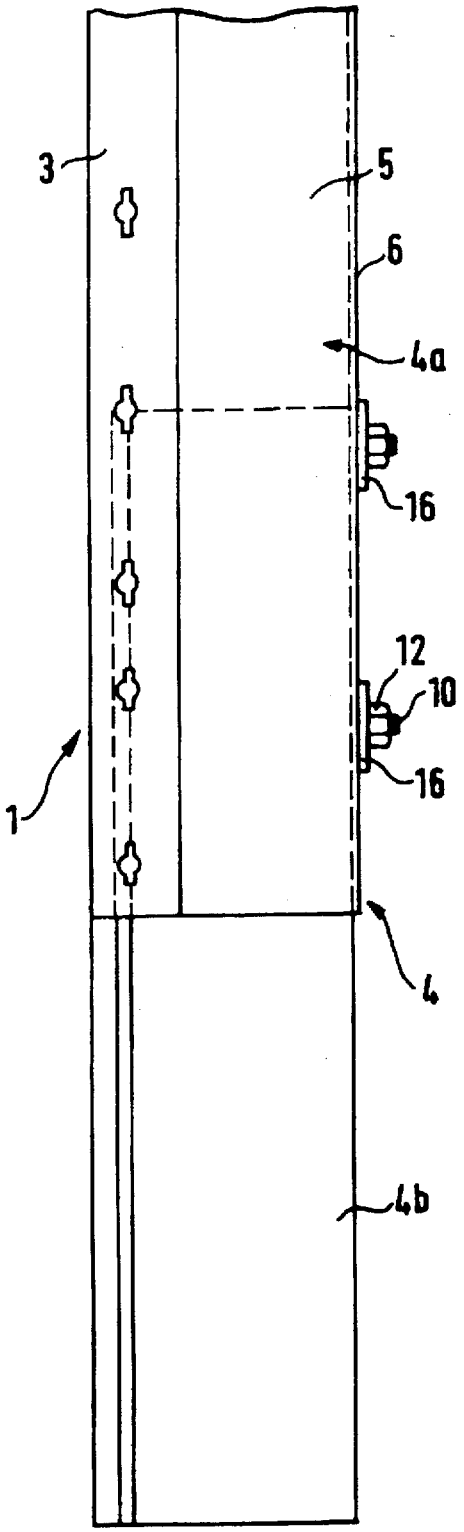

It becomes clear by reference to FIGS. 7 and 8 in conjunction with FIGS. 5 and 6 as well as FIGS. 2 to 4 that fasteners 10 having a radially protruding projection or head 9 engage with perforations 8 in the U-crosspiece 6 of the girder portion 4a situated externally in the position of use, the projection or head 9 being situated inside the cross section of the girder and engaging under companion Guiding means in the form of the edges of an elongated slot 11, hence a guide, of the internal girder portion 4b. These fasteners are adapted to be braced or tightened relative to the internal girder portion 4b at the external girder portion 4a. For this purpose the fasteners in the exemplified embodiment have at the outside of the girder 4 a thread and a nut 12 which can be screwed onto it and tightened. However fastening would also be conceivable with the aid of a key traversing a slot of the projecting part of the fastener 10.

According to FIGS. 5 and 6, the elongated slot 11 serving as a guide at the internal girder portion 4b is formed in that this girder portion 4b is composed of two approximately z-shaped girder sections which are arranged with mirror symmetry in relation to the longitudinal median plane and in the region of the U-crosspiece are spaced from each other by a slot, the girder sections being held together by cross connectors or cross plates 13 situated in the interior of the U-cross section. In contradistinction to a girder portion 4b which is bent from a plate to have an approximately trapezoidal cross section and would then have to be provided with longitudinal slots at the U-crosspiece 6, hence the girder portion is produced from the outset from two single pieces leaving the longitudinal slot 11 open between them.

According to FIG. 5 and FIGS. 2 to 4, the cross connectors or cross plates 13 have in the region of the guide slot 11 a recess 14 the inner width of which is larger than that of the companion guiding means, hence in the exemplified embodiment larger than that of the head 9 of the fastener 10. Therefore as long as the connection is still loose, the girder portion 4b can be moved relative to the fastener 10 and head 9 thereof without obstruction by a cross plate 13. Given a commensurately large number of perforations 8 in the U-crosspiece 6 of the external girder portion 4a, the overlapping zone shown in FIGS. 7 and 8 can be fixed for instance with two fasteners 10.

FIGS. 2 to 4 show different configurations of the head 9. According to FIG. 2, the fastener 10 may be a hammer-head bolt having a correspondingly shaped head which, if held in a corresponding recess, is not entrained as the nut 12 is twisted. It is however also possible that the shank zone directly adjoining the head 9 has a polygonal shape such that it cannot be twisted relative to the longitudinal slot 11. To improve the transfer of clamping forces from the nut 9 to the U-crosspiece 6, arranged under the nut 12 and a washer 15 there is also a supporting plate 16 of a width corresponding approximately to the width of the U-crosspieces 6.

According to FIGS. 2 and 5, the cross connectors or cross plates 13 of the internal girder portion 4b also contact the U-crosspiece 6 from the inside and from there are applied only to part of the cross-sectional length of the U-limbs 5 of this girder portion 4b. Therefore the lateral movability already mentioned of the U-limbs 5 is also largely retained in the region of these cross plates 13.

It suffices if, according to FIG. 6, in the longitudinal direction of the girder portion 4b the cross connectors or cross plates 13 are at a spacing at least almost corresponding to the length of this girder portion 4b. For improved stability, however, the spacing may be somewhat less than half this length of the girder portion 4b. In any case there is one such cross plate 13 near each front end of the girder portion 4b. This applies irrespective of whether the cross plates 13 distributed over the length of the girder portion 4b are two, three or even more in number. In the exemplified embodiment, a cross plate 13 is also provided midway of girder portion 4b in addition to the two cross plates 13 provided near the ends. FIG. 6 also shows the perforations 17 in the fastening flanges 7, for fasteners such as screws and nails to pass through for engagement with the lining skin 2.

Contrary to the form panel of FIG. 1, the form panel according to FIGS. 7 or 8 is provided with four girders 4, FIG. 7 showing an arrangement in which these girders are extended upwards by drawing out the same amount of each of the internal girder portions 4*b*. Such a form panel 1 therefore has a uniform upward extension.

FIG. 8 illustrates that with such a form panel 1 having four girders 4, the girders 4—as also in all the other exemplified embodiments—can also be extended downwards and the extension of each individual girder 4 may be different. According to FIG. 8, the extension increases for instance from left to right. Therefore the lower edge of a lining skin fitted to the extension runs at a slant in order to allow for, by way of example, the inclination of an approach ramp next to which a boundary wall is to be concreted with the aid of the form panel 1.

If one regards the form panels illustrated in part in FIGS. 7 and 8 as a common form panel, it becomes clear that it can be extended both downwards and upwards. A slanting edge might also be achieved in the upward direction by extensions of different length. The slant might be at an inclination parallel to or opposite to the lower one. There is hence potential for various forms of adaptation, requiring only that if need be the respective piece of lining skin is adapted in the region of the projecting girder portions 4*b*. However it is very simple for a user to enlarge a form panel 1, because girder portions 4*b* only have to be fitted into the girder portions 4*a* or girder portions 4*b* already existing there only have to be drawn out a suitable distance and then fastened to enable the support for heightening the form panel and lining skin 2. The possibility of being able to curve the form panel 1 and also change the curvature is preserved, even if the entire form panel 1 is extended in the manner described. Such form panels 1 can hence be used, for example, in constructing underground garages and their approach ramps, where the access ramps quite often require walls finishing at a slant at the top or bottom. Since such ramps may also have curves, it is particularly advantageous that the girders 4 and their girder portions 4*a* and 4*b* allow a curvature and change in the curvature of the form panel 1.

The form panel 1 has a lining skin 2 and girders 4 supporting the lining skin 2 on the side averted from the concrete, as well as possibly marginal webs 3 which run approximately parallel to the girders 4 and enable adjacent form panels 1 to be coupled and connected to one another. The girders 4 have an approximately U-shaped cross section, the U-limbs 5 departing from a U-crosspiece 6 to diverge slantwise and having at their free ends, where they are furthest apart from each other, oppositely directly fastening flanges 7 for joining to the lining skin 2. For the form panel to be extended on at least one side in continuation of the longitudinal direction of the girders 4, the girder 4 in question consists of at least two girder parts or portions 4*a* and 4*b* which are adjustable relative to each other in the longitudinal direction and embrace each other at least in an overlapping zone, whereby inside the cross section of the internal girder portion 4*b* the U-limbs thereof form together with the lining skin 2 an angle of inclination which is more obtuse or larger than the corresponding angle of the girder portion 4*a* embracing the girder portion 4*b*, or the angle between the two U-limbs of the internal girder portion 4*b* is more acute than the corresponding angle between the U-limbs 5 of the external girder portion 4*a*. The angles are selected in such a way that, when the U-crosspieces 6 are contiguous, the clear width at the lining skin 2 between the U-limbs 5 of the internal girder portion 4*b* is approximately the total width of the oppositely directed fastening flanges 7 smaller than the clear width at the same location between the U-limbs 5 of the external girder portion 4*a*, so that when the lining skin 2 is level the fastening flanges 7 of both girder portions lie side by side in the same plane.

I claim:

1. A form panel (1) with at least one girder (4) which supports a lining skin (2) on a side averted from a concrete location and has an approximately U-shaped cross section comprising U-limbs (5) of said girder connected by a U-crosspiece (6) situated on a side of said girder averted from the lining skin (2), and said U-limbs (5), viewed in cross section, diverging slantwise from the U-shaped crosspiece (6) and each having at free ends oppositely directed fastening flanges (7) which project outwardly from the U-limbs (5) and serve for being applied to the lining skin (2), characterized in that the girder (4) comprises two U-shaped girder portions (4*a*,4*b*) which are adjustable relative to each other in a longitudinal direction and comprise an at least partially internal girder portion and an external girder portion which embrace each other at least in an overlapping zone, whereby inside the cross section of the at least partially internal girder portion (4*b*) of the U-limbs (5) thereof form together with the lining skin (2) an angle of inclination which is more obtuse or larger than that of the external girder portion (4*a*) embracing the internal girder portion (4*b*), and that at the lining skin (2) the width between the U-limbs (5) of the internal girder portion (4*b*) plus the width of the oppositely directed fastening flanges (7) of the internal girder portion (4*b*) is smaller than that between the U-limbs (5) of the external girder portion (4*a*) so that when the lining skin (2) is level the fastening flanges (7) of both girder portions (4*a*,4*b*) lie side by side in the same plane.

2. A form panel as claimed in claim 1, characterized in that the U-crosspieces (6) of the two embracing girder portions (4*a*, 4*b*) are contiguous in a position of use and approximate each other in their width and are adapted to be detachably connected to each other.

3. A form panel as claimed in claim 1, characterized in that the girder portions (4*a*, 4*b*) are slidable relative to each other in the longitudinal direction of the girder (4) and that a slideway or longitudinal guideway comprises at least an elongated slot (11), provided at the U-crosspiece (6) of at least one of the girder portions.

4. A form panel as claimed in claim 1, characterized in that fasteners (10) having a radially protruding projection or head (9) engage with perforations (8) in the external girder portion (4*a*), the projection or head (9) being located inside the cross section of the girder and engaging under companion guiding means in the form of the edges of an elongated slot (11) of the internal girder portion (4*b*), and that the fasteners (10) are adapted to be braced or tightened relative to the internal girder portion (4*b*).

5. A form panel as claimed in claim 4, characterized in that the fastener (10) has at the outside of the girders (4) a thread and a nut (12) that is able to be tightened on it.

6. A form panel as claimed in claim 4, characterized in that the fastener (10) is safeguarded to prevent entrainment of its head (9) by taking the form of a hammer-head bolt.

7. A form panel as claimed in claim 1, characterized in that the internal girder portion (4*b*) is composed of two approximately z-shaped girder sections which are arranged with mirror symmetry in relation to a longitudinal median plane and in the region of the U-crosspiece (6) are spaced from each other by a guide slot (11), said girder sections being held together by cross connectors or cross plates (13) situated in the interior of the U-cross section.

8. A form panel as claimed in claim 7, characterized in that the cross connectors or cross plates (13) of the internal girder portion (4*b*) have situated in the region of the guide slot (11) a recess (14), the inner width of which is larger than that of the guide slot (11).

9. A form panel as claimed in claim 7, characterized in that the cross connectors or cross plates (13) of the internal girder portion (4*b*) contact the U-crosspiece (6) and from there are applied to part of the cross-sectional length of the U-limbs (5) of said girder portion (4*b*).

10. A form panel as claimed in claim 7, characterized in that in the longitudinal direction of the internal girder portion (4*b*), the cross connectors or cross plates (13) are at a spacing which is at least generally the length of the internal girder portion (4*b*) or generally less than half said length, and that two or more of the cross connectors or cross plates (13) are distributed over the length of the internal girder portion in such a way that one of the cross connectors or cross plates (13) is provided near each end and midway of the internal girder portion (4*b*).

11. A form panel as claimed in claims 1, characterized in that the U-limbs of the girder portions (4*a*, 4*b*) are laterally movable without permanent deformation and the form panel (1) is adapted to be curved and varied in its curvature about one or a plurality of axes running parallel to the girder(s) (4).

* * * * *